US008322061B1

(12) United States Patent
Kraft

(10) Patent No.: US 8,322,061 B1
(45) Date of Patent: Dec. 4, 2012

(54) DISTRIBUTION MARKETING PIECE

(75) Inventor: Roger E. Kraft, Fort Scott, KS (US)

(73) Assignee: Ward-Kraft, Inc., Fort Scott, KS (US)

( * ) Notice: Subject to any disclaimer, the term of this patent is extended or adjusted under 35 U.S.C. 154(b) by 243 days.

(21) Appl. No.: 12/818,849

(22) Filed: Jun. 18, 2010

Related U.S. Application Data

(60) Provisional application No. 61/218,731, filed on Jun. 19, 2009.

(51) Int. Cl.
*G09F 3/10* (2006.01)

(52) U.S. Cl. ..... 40/638; 283/81

(58) Field of Classification Search ..... 40/638; 283/81

See application file for complete search history.

(56) References Cited

U.S. PATENT DOCUMENTS

| | | | | |
|---|---|---|---|---|
| 5,340,158 | A | 8/1994 | Bartl | |
| 5,393,264 | A | 2/1995 | Kraft et al. | |
| 5,405,475 | A | 4/1995 | Kraft et al. | |
| 5,413,383 | A | 5/1995 | Laurash et al. | |
| 5,580,640 | A | 12/1996 | Kraft et al. | |
| 5,716,688 | A * | 2/1998 | Burke et al. | 428/43 |
| 5,730,469 | A * | 3/1998 | Heimerdinger et al. | 283/81 |
| 5,735,549 | A | 4/1998 | Konkol et al. | |
| 5,776,571 | A * | 7/1998 | Michlin et al. | 428/40.1 |
| 6,186,554 | B1 | 2/2001 | Raming | |
| 6,213,518 | B1 | 4/2001 | Raming | |
| 6,244,629 | B1 * | 6/2001 | Chess | 283/66.1 |
| 6,340,512 | B1 | 1/2002 | Mercer et al. | |
| 6,368,688 | B1 | 4/2002 | Crum et al. | |
| 6,394,500 | B1 * | 5/2002 | Nixon et al. | 283/101 |
| 6,616,189 | B2 * | 9/2003 | Raming | 283/81 |
| 6,698,116 | B2 | 3/2004 | Waldron | |
| 6,743,493 | B2 | 6/2004 | Crum et al. | |
| 6,773,181 | B2 | 8/2004 | Crum | |
| 6,947,777 | B2 | 9/2005 | Crum | |
| 6,948,742 | B2 * | 9/2005 | Buck | 283/56 |
| 6,953,207 | B2 | 10/2005 | Raming | |
| 6,984,083 | B2 | 1/2006 | Crum | |
| RE38,976 | E | 2/2006 | Raming | |
| 7,024,807 | B2 | 4/2006 | Street | |
| 7,029,001 | B2 | 4/2006 | Crum | |
| RE39,100 | E | 5/2006 | Raming | |
| 7,618,034 | B2 | 11/2009 | Crum | |
| 7,681,921 | B2 | 3/2010 | Mercer et al. | |
| 7,891,490 | B2 | 2/2011 | Raming | |
| 2005/0150187 | A1 | 7/2005 | Raming | |
| 2005/0191972 | A1 | 9/2005 | Crum | |
| 2006/0091671 | A1 | 5/2006 | Raming | |
| 2006/0170143 | A1 | 8/2006 | Crum | |
| 2009/0289447 | A1 | 11/2009 | Crum | |
| 2010/0156087 | A1 | 6/2010 | Raming | |
| 2011/0052297 | A1 | 3/2011 | Bosley et al. | |

* cited by examiner

*Primary Examiner* — Lesley D Morris
*Assistant Examiner* — Kristina Junge
(74) *Attorney, Agent, or Firm* — Hovey Williams LLP

(57) ABSTRACT

A distribution marketing piece is designed to be adhered to and carried by a substrate and includes a top ply selectively adhered to a liner ply. A transverse line of separation divides the top ply into first and second sections, each section having side strips and the first section having *a central portion and the second section having a center section. Removal of the liner before application of the top ply to the substrate results in removal of the side strips along the second section which are carried with the liner ply; a portion of the liner ply remains adhered **to the first and second sections to connecting them. By folding the liner ply and the connected part of the first and second sections, the first section adheres to the substrate surrounding the center section and the central portion to define a pocket free of adhesive connection to the substrate.

12 Claims, 7 Drawing Sheets

DISTRIBUTION MARKETING PIECE

BACKGROUND OF THE INVENTION

1. Field of the Invention

The present invention concerns a marketing piece for application to a substrate such as an envelope or container and which provides, when applied to the substrate, a pocket wherein a portion of the marketing piece is received and held in place.

2. Description of the Prior Art

It is well-known in the art to apply labels to substrates such as envelopes and containers. Those labels typically use a wettable or pressure sensitive adhesive to attach the label to the substrate. In the case of a label having pressure sensitive adhesive, the label is typically provided to the user with a backing or carrier sheet having a silicone release coating which facilitates the separation of the label from the backing. More recently, various different types of labels have been developed which are adapted to provide several plies on which printable indicia is applied. Moreover, the labels heretofore developed are designed to provide a recipient address to facilitate mailing of the substrate. Examples of various labels are shown in U.S. Pat. Nos. 5,413,383, 5,735,549, 6,186,554, 6,213,518, 6,394,500 and 6,616,189, the entire disclosures of which are incorporated herein by reference.

Also known in the art are advertising solicitations sent by mail. These pieces are typically in form of letters or postcards which must meet postal standards for handling. Such advertising campaigns have a significant expense not only in the cost of material and labor involved in printing, but also high postage costs (currently about $0.23 for bulk mail) and handling costs. Such advertising campaigns involving mass mailings are often regarded by the recipient as "junk mail" and it is not uncommon for many such mailings to be discarded without being read by the recipient. Moreover, such advertising campaigns have significant ecological costs, in that additional energy is required to transport the mailings and the high rate of discard adds to landfill tonnage.

It is an object of the present invention to provide a marketing piece which can be applied to a substrate in a manner like a label, but wherein the construction of the marketing piece provides significant flexibility in use, together with a degree of security. It is a further object of the present invention to provide a marketing piece which can reduce handling and transport costs and reduce landfill tonnage. Furthermore, it is an object of the present invention that can be more specifically targeted to recipients than conventional mass mailings, and thus decrease useless and unproductive marketing materials.

SUMMARY OF THE INVENTION

These and other objects are obtained by the present invention which provides a marketing piece designed to be applied to a substrate such as an envelope or container. The marketing piece is designed to be applied in a manner so as to provide a pocket into which advertising materials, or a packing list, can be placed, but which is uniquely constructed to facilitate access to the pocket and removal of its contents. By attaching the marketing piece to a substrate anticipated or desired by the recipient, not only can the user choose between different marketing pieces and then apply the marketing piece most closely associated with the demographic of the contents of the substrate, but the recipient is much more likely to review and consider the marketing message as compared to conventional "junk mail." Typically there is no additional postage or shipping costs when the marketing piece is "piggy-backed" onto another substrate.

In greater detail, the marketing piece of the present invention in its basic form includes a top ply and a liner ply. In this basic form, the top ply is printed with indicia on one, normally the uppermost side, and has another back side in opposition to the liner ply. The top ply is printed with indicia, such as advertising, promotional or marketing information on one side, and most preferably the indicia is printed in a four color process. The top ply is provided in two segments. Lines of weakness, such as a score line or perforations, provide a tear strip extending at least partially and preferably substantially completely across a first segment of the top ply near a bottom edge thereof. Additional lines of weakness are provided in the first segment transverse and preferably perpendicular to the tear strip. A further line of weakness extends across the top ply to divide the first segment from the second segment, and at least two spaced apart lines of weakness substantially intersect and extend upwardly from the further line of weakness to provide a separable central portion on the second segment.

The liner ply has a back surface and an intermediate surface which is juxtaposed to and opposite the another side of the top ply. A layer of silicone release coating is applied to parts of the intermediate surface. The liner ply has a bottom margin, top margin, and left and right side margins. Lines of separation, such as are made by die-cutting, are provided in the liner ply. One transverse line of separation extends across the liner ply a portion of the distance between the left and right side margins. A transverse line of weakness, which is preferably substantially parallel to the transverse line of separation but spaced therefrom, is provided in the liner ply between the transverse line of separation and the top margin. Two substantially parallel lines of separation then extend in a direction from the transverse line of separation toward the top margin. Preferably, part of the distance between the bottom margin and the top margin a narrowing region is provided, where the parallel lines of separation converge, and then continue in substantially parallel relationship to or at least proximate the top margin. The silicone release coating is preferably applied to the portion of the liner ply between the transverse line of separation and the bottom margin, between the parallel lines of separation and the respective left and right side margins in the area of the first segment of the top ply but preferably not applied to the intermediate surface in the part of the liner ply in the area corresponding to the second section and that portion of the liner ply extending upwardly from the transverse line of separation to the top margin. Adhesive, preferably a pressure-sensitive adhesive, is applied (preferably to the liner ply) between the intermediate surface and the back side of the top ply, although to facilitate removal of the tear strip, adhesive is preferably not provided between the top ply and the liner ply in the area of the tear strip except adjacent the left and right side margins. The adhesive may be applied as a continuous coat of adhesive, or intermittently in a pattern coating.

In especially preferred embodiments, a card, coupon or the like may be adhered by, for example, a hot-melt adhesive, to the uppermost side of the top ply to the second section. Also, if desired, indicia can be printed on that portion of the back surface of the liner ply which remains with the top ply when applied to a substrate as described below, and also could be printed in a four color process which provides for improved color imaging.

The foregoing construction enables a novel application to a substrate which facilitates application, protects the second section during shipping, and creates a pocket from which the second section or other materials placed in the pocket may be easily removed. The distribution marketing piece hereof may be provided individually, or plural distribution marketing pieces may be provided by top sections applied to a continuous liner ply and fan-folded or provided as roll stock. The user first separates the top ply from the liner ply adjacent the bottom margin. As the top ply is peeled away to expose the adhesive, the portions of the second section of the top ply between the lines of weakness and the side margins remain connected to the liner ply and are discarded as waste. The second section is then folded downwardly along the transverse line of weakness in the liner ply to expose a peripheral pattern of adhesive surrounding a central portion of the first section of the top ply. The second section thus lies inwardly of the peripheral pattern of adhesive, and is not adhered to the substrate. The first section is then applied to the substrate, creating a pocket into which the second section, still connected to the first section, is received. The second section is confined in this pocket by virtue of being substantially surrounded by the adhesive connection between the surrounding portion of the first section and the substrate. To gain access to the pocket and its contents, the recipient of the substrate grasps the tear strip adjacent a side edge and tears it away. The user then reaches into the pocket and removes the second section and the part of the liner adhered thereto. The second section is easily separable from the first section along the transverse line of weakness, and when a card, coupon or the like is adhered by hot glue or the like to the second section, the second section carries with it the attached card.

During formation of the pocket, additional plies of material may be inserted. For example, a packing slip can be inserted between the second section and the first section prior to, during or after folding, but before sealing of the peripheral pattern of adhesive. Thus, a number of different coupons or other marketing materials can be provided to the recipient without additional shipping costs.

These and other advantages will be readily apparent to those skilled in the art with reference to the accompanying drawings and detailed description which follows.

DESCRIPTION OF THE PREFERRED EMBODIMENT

Figure 6:
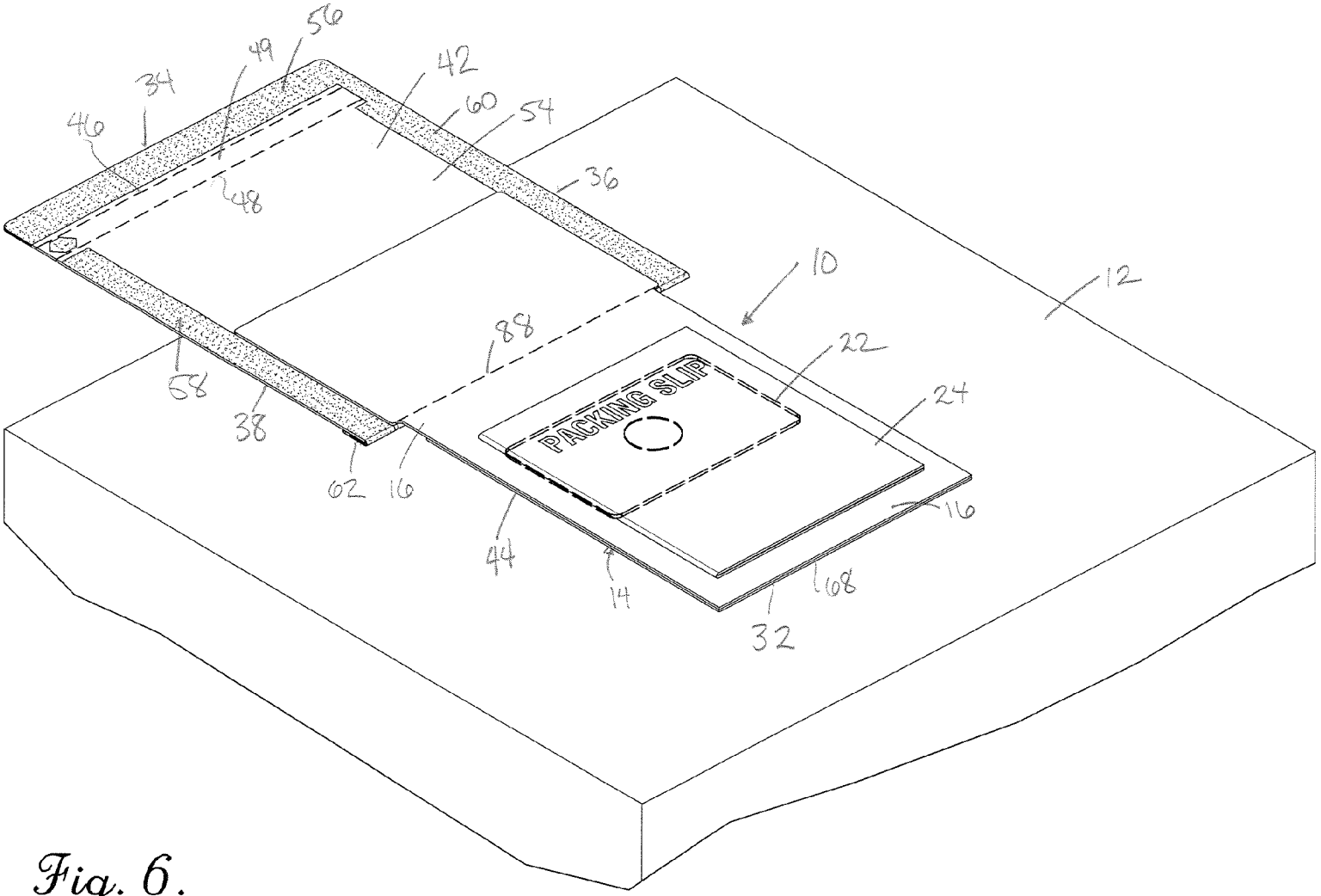
FIG. 6 is an isometric view of the distribution marketing piece partially adhered to a substrate by adhesive along the top portion of the first section and ready for folding and full adherence to form a pocket with the waste portion of the liner and top ply removed.
Figure 7:
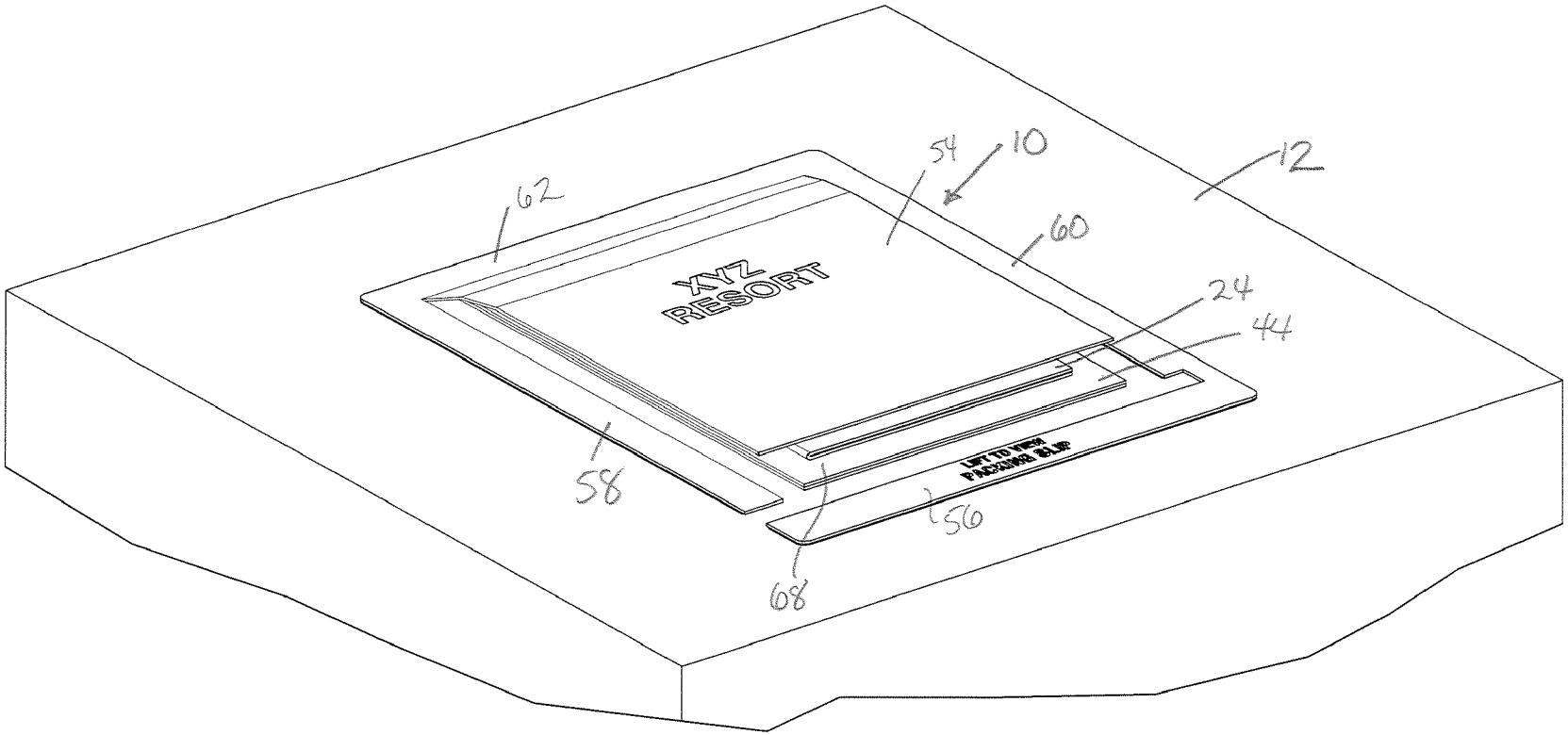
FIG. 7 is an isometric view similar to FIG. 6 after folding of the first section of the top ply, and after subsequent removal of the tear strip and during lifting of the central portion of the first section of the top ply.
Figure 8:
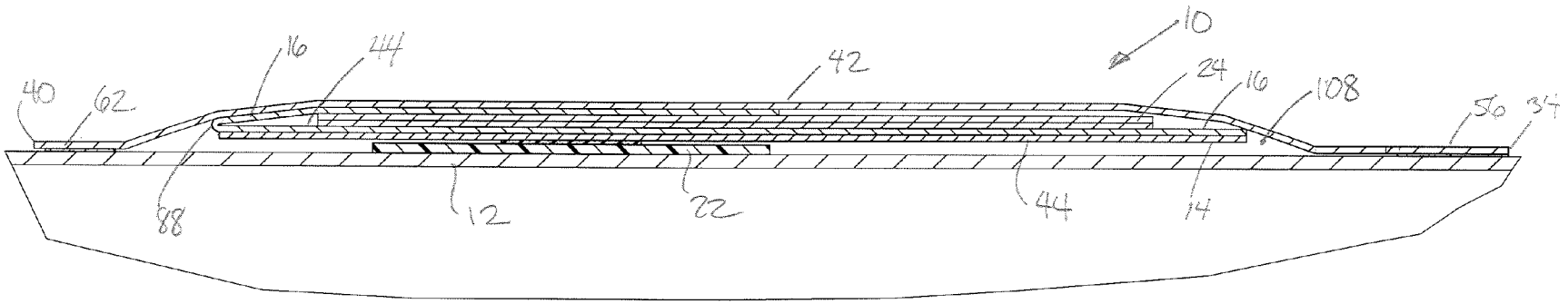
FIG. 8 is a vertical cross-sectional view through the distribution marketing piece as adhered to the substrate to form a pocket, and with a card attached to the top ply and an insert placed between the first section and second section after folding.

Referring now to the drawing, a distribution marketing piece 10 in accordance with the present invention is adapted for adhering to a substrate 12 as shown in FIGS. 6, 7 and 8. The substrate 12 may be an envelope, carton, tube or other article which is typically shipped by post or commercial carrier. The distribution marketing piece hereof includes a top ply 14 and a liner ply 16, having layers of adhesive 18 and a release coating 20 positioned therebetween. In particularly preferred embodiments, a card 22, which as used herein includes any printable material such as paper, cardstock, plastic or the like of a smaller size than the top ply 12 and which may include advertising material or be for purposes such as gift cards, prepaid calling cards, coupons or the like, may be adhered to the top ply 14 and an insert 24 of any printable material may be inserted into the distribution marketing piece 10 as described herein.

Figure 1:
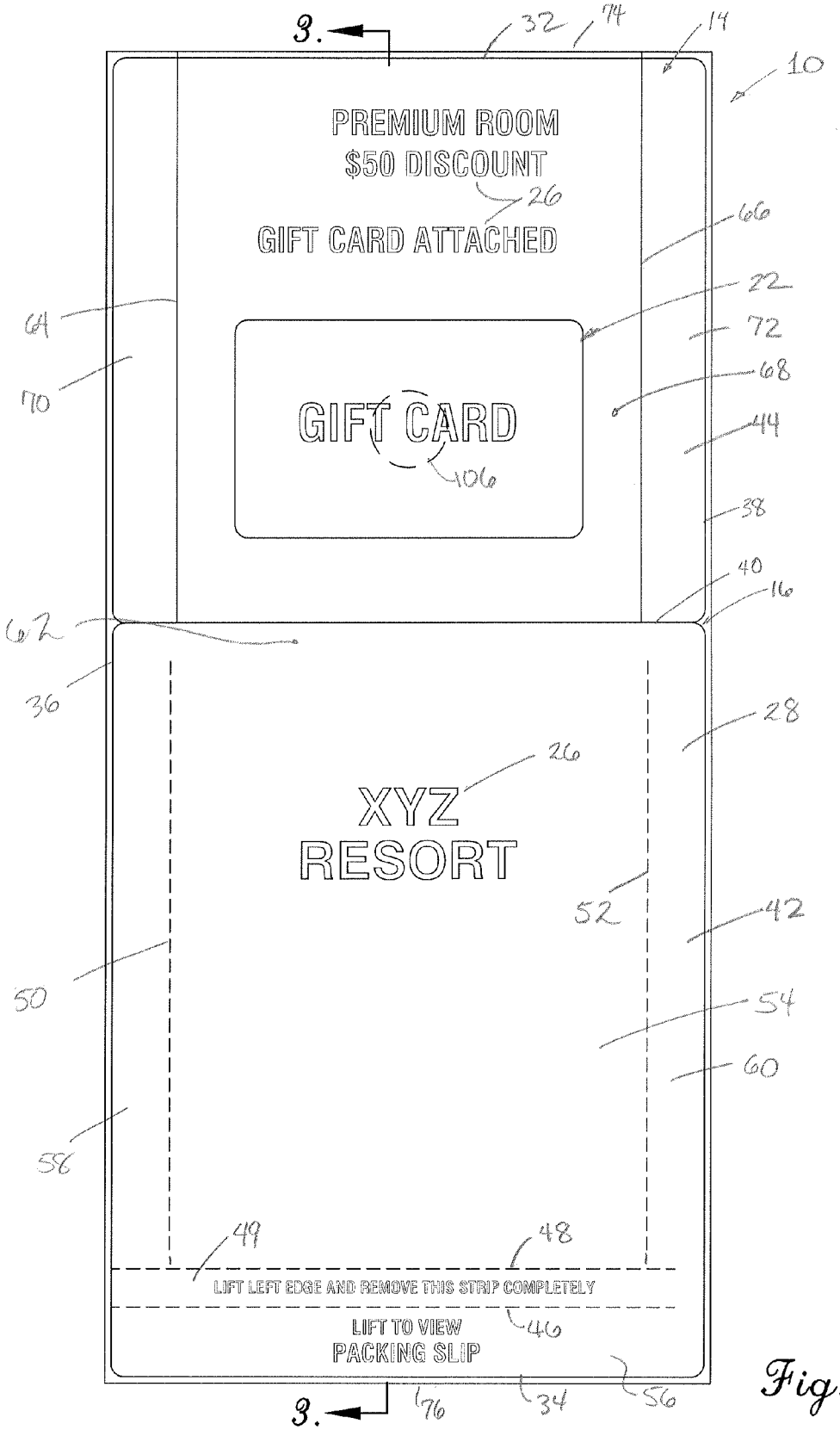
FIG. 1 is a front view of a distribution marketing piece in accordance with the present invention, shown as an individual sheet wherein the liner ply extends outboard of the top, bottom and side edges of the top ply.

In greater detail, the top ply 14 is preferably printed with indicia 26 on an uppermost side 28 as shown, for example, in FIG. 1, and has a back side 30 receiving the adhesive 18 thereon. While black and white printing of alphanumeric characters is shown in the drawing, it is to be understood that in use, 2 color printing or 4 color (cyan, magenta, yellow and black) printing of indicia 26 including alphanumeric characters and other images would be employed to convey an acceptable advertising image on the uppermost side 28. The adhesive 18 is preferably a pressure-sensitive adhesive which may be applied in a variety of methods as well known to those skilled in the art. The top ply 14 includes a top edge 32, a bottom edge 34, a left side edge 36 and a right side edge 38. A first transverse line of separation 40 extends substantially between the left side edge 36 and the right side edge 38 and divides the top ply into a first section 42 which includes the bottom edge 34 and a second section 44 which includes the top edge 32. Lines of separation as used herein are typically provided by die or other cutting through the top ply 14. Additionally, first transverse line of weakness 46 and a parallel second transverse line of weakness 48 extend substantially across the top ply 14 from the left side edge 36 to at least proximate the right side edge 38. The lines of weakness as used herein are preferably provided by perforations or scoring in the top ply, and the first and second transverse lines of weakness are located proximate the bottom edge 34 and define a tear strip 49 for purposes as will be discussed below.

The first section 42 of the top ply 14 includes additional longitudinally extending third line of weakness 50 and longitudinally extending fourth line of weakness 52. The third and fourth lines of weakness are preferably substantially parallel to each other, and intersect with and extend upwardly from the second transverse line of weakness 48, and may, but preferably do not, extend upwardly to intersect with the first transverse line of separation 40. A central portion 54 of the top ply 14 is thus defined above between the third and fourth lines of weakness extending from the second line of weakness 48 up to the first transverse line of separation 40. A bottom edge strip 56 is provided in the top ply 14 between the first line of weakness 46 and the bottom edge 34. A first side strip 58 is provided between the third line of weakness 50 and the left side edge 36 and a second side strip 60 is provided between the fourth line of weakness 52 and the right side edge 38. An upper border section 62 is provided between the left side edge 36 and the right side edge 38 adjacent to the first transverse line of separation 40.

The second section 44 of the top ply 14 includes second line of separation 64 proximate the left side edge 36 and a third line of separation 66 proximate the right side edge 38. Both the second and third lines of separation are preferably parallel to one another and are substantially perpendicular to and intersect with the first transverse line of separation 40, extending from the first transverse line of separation 40 to the top edge 32. The second and third lines of separation may also be score lines that substantially, but not completely extend through both the top ply 14 and the liner ply 16, such that a center section 68 of the second section 44 remains attached to third side strip 70 between the center section and the left side edge 36 and a fourth side strip 72 located between the center section 68 and the right side edge 38 during normal handling but the third and fourth side strips are easily separated from the center section 68 when desired.

Figure 4:
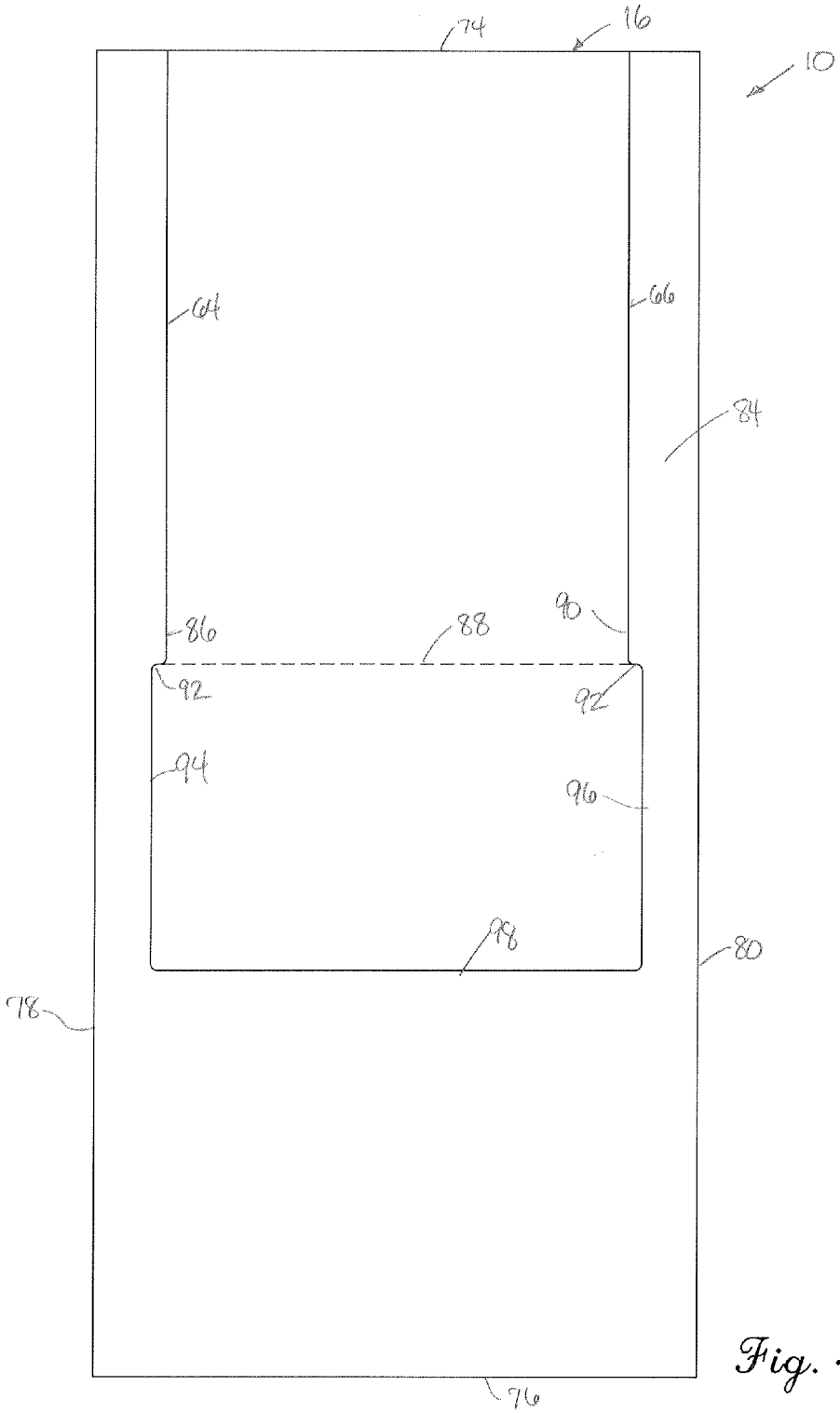
FIG. 4 is a rear view of the distribution marketing piece showing the lines of separation and the transverse line of weakness in the liner ply.

The liner ply 16 is, as shown in FIG. 1, ofpaper or synthetic resin and has slightly larger dimensions than the top ply 14 to facilitate peeling of the top ply 14 from the liner ply 16 when desired. The liner ply 16 has a top margin 74, a bottom margin 76, a left side margin 78 and a right side margin 80, an intermediate surface 82 and a back surface 84. As noted above, the second line of separation 64 and the third line of separation 66 extend downwardly from the top margin 74 substantially through the liner ply 16 as well as through the top ply 14 to the first transverse line of separation 40. However, a second extension line of separation 86 is substantially aligned and in registry with the second line of separation and continues through the liner ply 16 only (and not also the top ply 14) to a fifth transverse line of weakness 88 extending partway across the liner ply 16 as shown in FIG. 4. Similarly, a third extension line of separation 90 is substantially colinear with the third line of separation and continues through the liner ply only (and not also the top ply 14) to the fifth transverse line of weakness 88. Where the second and third extension lines of weakness 86 and 90 intersect with the fifth transverse line of weakness 88, the second and third lines of weakness slightly diverge to provide a narrowing region 92. Fourth line of separation 94 and fifth line of separation 96, which is parallel to and spaced apart from fourth line of separation 94, then extend downwardly to a sixth transverse line of separation 98. The fourth line of separation 94 is located slightly more proximate to the left side margin 78 than is second line of separation 64, and fifth line of separation is also located slightly more proximate to the right side margin 80 than is third line of separation 66. As a result, the width of the center section 68 is slightly less than the width between the fourth and fifth lines of separation. Also, the fourth line of separation 94 is preferably in substantial alignment and registry with the third line of weakness 50, and the fifth line of separation 96 is preferably in substantial alignment and registry with the fourth line of weakness 52, so that the central portion 54 is slightly wider than the center section 68.

Figure 2:
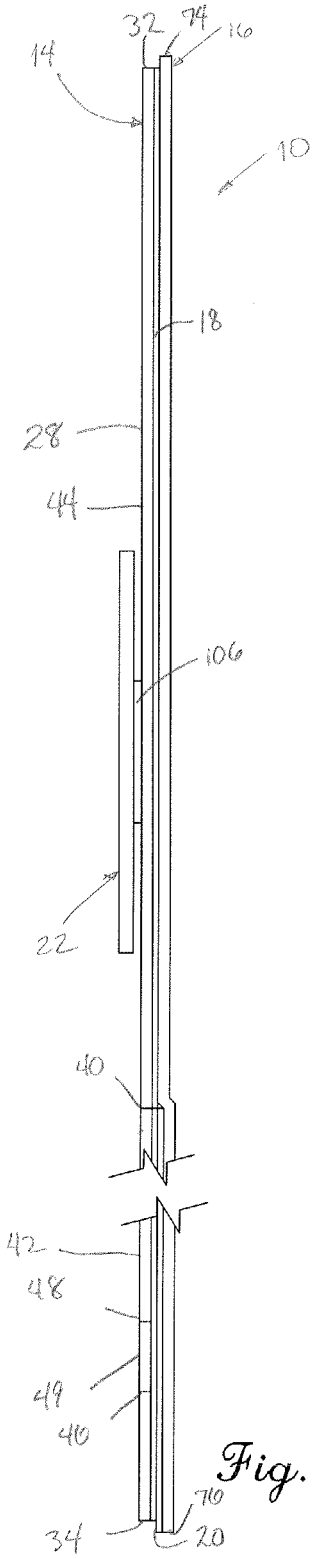
FIG. 2 is a right side elevational view thereof, with a portion of the distribution marketing piece in the area of the first section foreshortened, showing the top ply and liner ply with adhesive and release coating applied therebetween.
Figure 3:
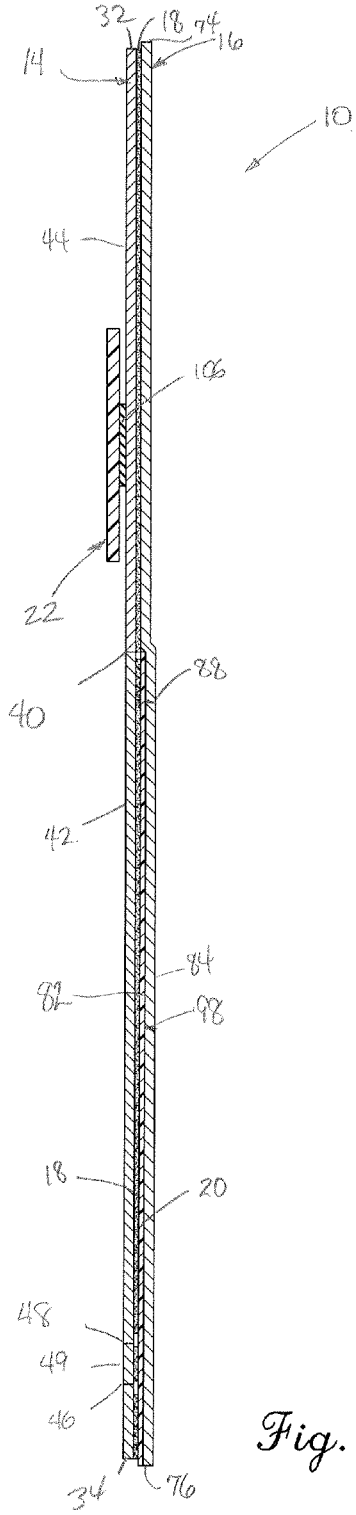
FIG. 3 is a vertical cross-sectional view taken along line 3-3 of FIG. 1 and similar to FIG. 2, showing the areas of adhesive and release coating between the top ply and the liner ply.
Figure 5:
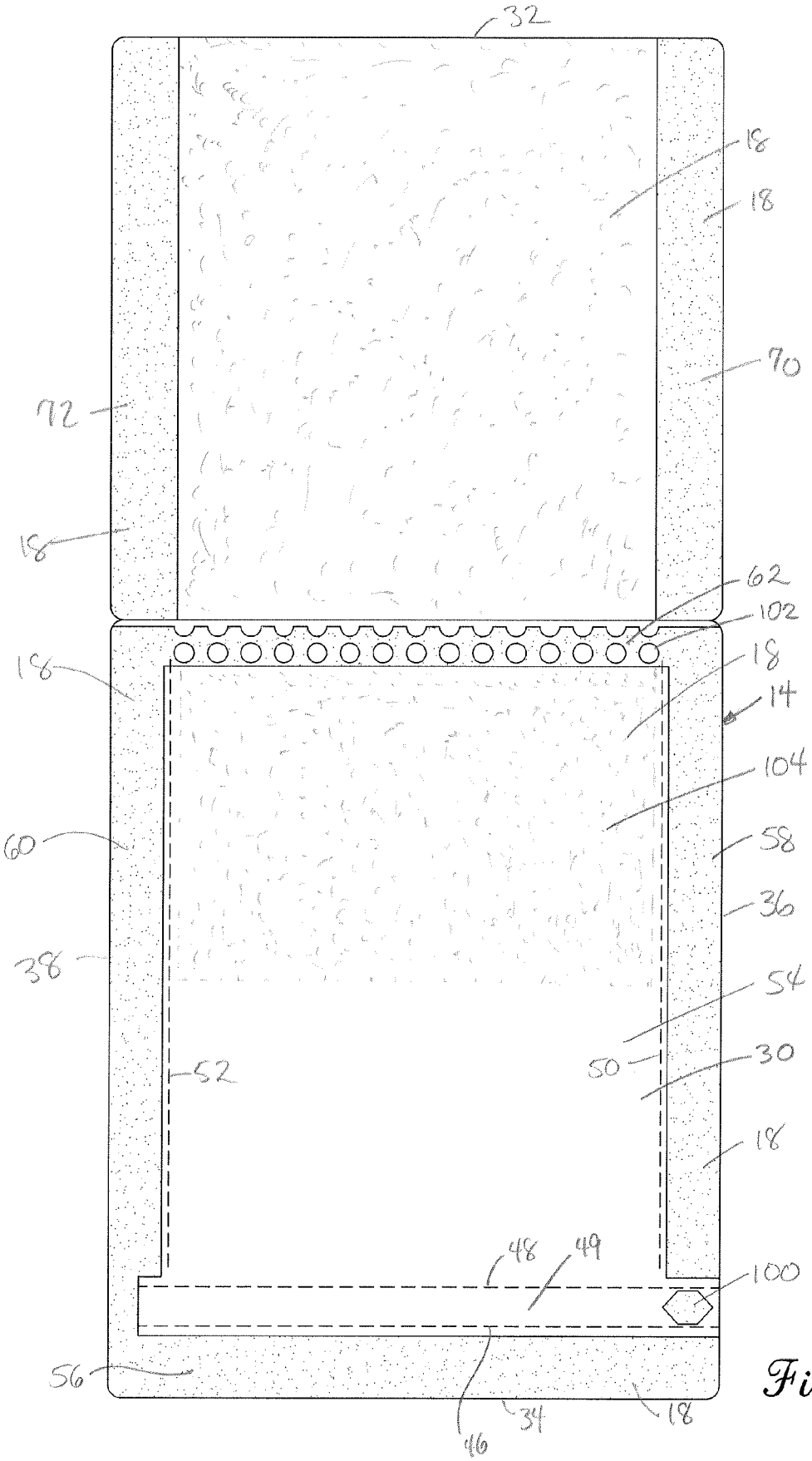
FIG. 5 is a rear view of the back side of the top ply of the distribution marketing piece and without the liner ply showing the location of the adhesive between the top ply and the liner ply, and showing the lines of separation and lines of weakness.

Adhesive 18 is applied to selected locations between the top ply 14 and the liner ply 16 as shown in the drawings and described herein. The adhesive is preferably a pressure sensitive adhesive and may be applied to either the liner ply 16 or to the top ply 14. With particular reference to FIGS. 2, 3 and 5, the latter showing the positioning of the adhesive relative to the back side 30, adhesive 18 is positioned to extend over bottom edge strip 56 adjacent the bottom edge 34 but spaced from the first line of weakness to avoid impairment in removal of the tear strip 49. A patch 100 of adhesive 18 is provided on the tear strip 49 adjacent the left side edge 36 to resist undesired separation of the tear strip 49 from the substrate 12. Adhesive 18 also extends along first side strip 58 and second side strip 60 outboard respectively of the third line of weakness 50 and the fourth line of weakness 52, whereby the back side 30 of the center portion is without exposed adhesive 18 when applied to the substrate 12. It may be desirable to lessen the adhesion between the top ply 14 and the substrate 12 in some locations, and in that regard adhesive 18 may be applied intermittently or in a pattern 102 as shown in FIG. 5 along the upper border section 62. Adhesive 18 also extends along the back side 30 of the third side strip 70 and the fourth side strip 72 of the second section as shown in FIG. 5. Adhesive 18 also is provided in an adhesion region 104 along the back side 30 between the upper border section 62 downwardly partway toward bottom edge 34 to a line substantially aligned with the sixth transverse line of separation 98. Adhesive 18 is further provided along the back side 30 of the center section 68 between the second line of separation 64 and the third line of separation 66.

Release coating 20 is selectively applied to the intermediate surface 82 so as to provide a releaseable attachment between parts of the liner ply 16 and the top ply 14, and in other parts a relatively permanent attachment. In this regard, release coating 20 is applied along substantially all of the liner ply 16 except for that portion which is opposite the adhesion region 102 of the back side 30 of the top ply 14, and substantially all of the liner ply opposite the second section 44. That is to say, release coating 20 is applied to the intermediate surface 82 at least opposite the first side strip 58, the second side strip 60, the upper border section 62 and the bottom edge strip 56. Release coating 20 is preferably NOT applied to the intermediate surface 82 opposite the center section 68, the third and fourth side strips 70 and 72, and the adhesion region 104 in order that the liner ply 14 remain affixed to the top ply 12 in those portions.

As may be seen in FIGS. 1, 2, 3 and, in broken lines, FIG. 6, card 22 may be attached to the uppermost side 28 of the second section 44 and retained thereon by adhesive, such as meltable or "hot" glue 106 which may be readily scraped from the card 22. Although not shown in the drawing, indicia may also be printed on the back side of the liner ply 16.

The assembly of the distribution marketing piece 10 hereof in view of the foregoing description is well known to those of ordinary skill in the art. After setup of printing presses, indicia is printed on the top ply and release coating and adhesive are applied in the desired arrangement by rollers, sprays or the like. The plys are then mated, die cut, excess top ply material stripped away, if desired the optional card is applied and the mated plys are then packed ready for application as cut sheets, fan folded, rollstock or the like.

The distribution marketing piece 10 may be applied to the substrate 12 already containing other materials to be sent to the recipient. For example, the substrate 12 may be a container or envelope, with the distribution marketing piece 10 applied to the exterior. The user typically applies the distribution marketing piece 10 to the substrate 12 by peeling or lifting the top ply 14 from the liner ply 16 beginning at the bottom edge 34. As the top ply 14 is peeled away, that portion of the liner ply 14 covering the back side 30 between the sixth transverse line of separation 98 and the top edge 32 remains with the top ply 14. Also, as the top ply 14 is peeled away from the liner ply 16, the third side strip 70 and fourth side strip 72 of the top ply 14 remain with the removed portion of the liner ply 16 to be discarded or recycled as waste. The distribution marketing piece 10 is then most advantageously adhered to the substrate 12 by first placing the center section 68 atop the desired location of the package and adhering the upper border section 62 to the substrate. When the indicia are printed on only to uppermost side of the top ply 14, the printed indicia will then be facing down toward the receiving surface of the substrate, and the back surface 84 covering the center section 68 of the top ply 14 will be facing up, and the card 22, if attached to the center section 68 of the top ply 14, will be between the center section 68 and the receiving surface of the substrate 12. One insert 24 or a plurality of inserts 24 may then be placed on the back surface 84 as shown in FIG. 6. Then, the user folds the distribution marketing piece along the fifth transverse line of weakness 88. The adhesive 18 on the upper border section 62, the first side strip 58 and the second side strip 60, and between the bottom edge and the tear strip 49 to create a pocket 108 free of adhesion between the distribution marketing piece 10 and the substrate 12 into which the center section 68, the insert 24, and the card 22 are received and confined by the first side strip 58, second side strip 60, upper border section 62 and bottom edge strip 56 which surrounds the central portion 54. The indicia such as marketing information printed on uppermost side of the first section 52 is then exposed and visible to a recipient, which the center section 68, the card 22 and insert(s) 24 are hidden beneath the central portion 54 as shown in FIG. 8. The substrate 12 is then ready for shipping or mailing, with substantially no free edges, i.e., no portions of the first section which not adhered by adhesive 18 to the substrate 12.

When the substrate 12 is received by the recipient, the tear strip 49 may be torn away by lifting adjacent the right side edge and tearing along the first and second transverse lines of weakness 46 and 48. As shown in FIG. 7, removal of the tear strip 49 exposes the pocket and the central portion 54 may be lifted and torn along third and forth lines of weakness 50 and 52 to gain access to the contents of the pocket 108. The center section 68 may be removed by grasping it and tearing it along the fifth transverse line of weakness 88. This then exposes the indicia printed on the uppermost side of the center section and, when the card 22 is attached, the card 22. When the card 22 is used, it can be readily separated from the center section 68 because the use of a hot glue has relatively weak adhesion.

As a result, a relatively inexpensive distribution marketing piece 10 is provided which can be piggy backed to a substrate 12 to reduce waste and shipping costs. Further, the choice among several distribution marketing pieces 10 to apply to a particular substrate may be made corresponding to the demographics of the recipient by geographic location, contents of the substrate 12, or other choices. The contents of the insert 24, such as a coupon, card 22 such as a gift card, and the central portion 54 are protected from pilferage or damage during shipping by their enclosure within the pocket 108.

The invention claimed is:

1. A distribution marketing piece adapted for adhesive attachment to a substrate, said distribution marketing piece comprising:

a top ply having an uppermost side and a back side, a top edge, a bottom edge, and first and second side edges, a first line of separation extending substantially between said first and second side edges and providing a first section including said bottom edge and a second section including said top edge;

a liner ply having an intermediate surface and a back surface;

a layer of release coating applied to at least a part of the intermediate surface of the liner ply;

a layer of adhesive applied between at least a part of the back side of the top ply and at least a part of the intermediate surface of the liner ply, wherein upon separation of the liner ply from the top ply, at least some of said adhesive is carried with and adheres to said top ply, said distribution marketing piece further including a second line of separation and a third line of separation extending substantially through both said top ply and said liner ply, said second line of separation and said third line of separation being substantially parallel to one another and perpendicular to said first line of separation, said liner ply further including a transverse line of weakness oriented substantially parallel to said first line of separation and spaced therefrom to define therebetween an upper border section having at least some of said layer of adhesive defining an exposed adhesive region positioned on the back side of the top ply when the portion of the liner ply positioned adjacent to the upper border section is removed from the top ply, further including a second extension line of separation extending substantially through said liner ply and substantially co-linear with and extending longitudinally from said second line of separation, and a third extension line of separation extending through said liner ply and substantially co-linear with and extending longitudinally from said third line of separation, wherein said second extension line of separation and said third extension line of separation are substantially parallel to one another and do not extend substantially through said top ply, and wherein said second extension line of separation and said third extension line of separation extend to and intersect with said transverse line of weakness.

2. A distribution marketing piece as set forth in claim 1, further including a second line of weakness in said first section of said top ply oriented substantially parallel to said first line of separation, a third line of weakness in said first section of said top ply substantially perpendicular to said second line of weakness and extending substantially between said first line of separation and said second line of weakness, and a fourth line of weakness in said first section of said top ply substantially perpendicular to said second line of weakness and extending substantially between said first line of separation and said second line of weakness, said third line of weakness being positioned more proximate said first side edge than said second side edge, said fourth line of weakness being substantially parallel to said third line of weakness and positioned more proximate said second side edge than said first side edge.

3. A distribution marketing piece as set forth in claim 2, wherein a first side strip is defined in said first section of said top ply between said third line of weakness and said first edge and a second side strip is defined in said first section of said top ply between said fourth line of weakness as said second edge, wherein said first section of said top ply includes a further line of weakness extending substantially across said first section and substantially parallel to said second line of weakness and positioned proximate to the bottom edge to define a tear strip between said second line of weakness and said further line of weakness and to define a bottom edge strip between said bottom edge and said further line of weakness, wherein said layer of adhesive includes adhesive applied between said top ply and said intermediate surface of said liner ply to at least said first side strip, said second side strip, said upper border section and said bottom edge strip, and wherein said layer of release coating is selectively applied to the intermediate surface of said liner ply opposite said first side strip, second side strip, upper border section and said bottom edge strip.

4. A distribution marketing piece as set forth in claim 3, wherein said second section includes a center section positioned between said second line of separation and said third line of separation, a third side strip positioned between said first edge and said second line of separation, and a fourth side strip positioned between said second edge and said third line of separation, wherein said layer of adhesive includes adhesive applied between said layer of release coating and the back side of said center section, said third side strip and said fourth side strip, and wherein said layer of release coating is selectively applied such that release coating is substantially not applied between the intermediate surface and the back surface opposite the center section, the third side strip and the fourth side strip.

5. A distribution marketing piece as set forth in claim 4, said liner ply further including an additional transverse line of separation oriented substantially parallel to and spaced from a transverse line of weakness, said transverse line of weakness being positioned between said transverse line of separation and a top margin of said liner ply, said liner ply further including a fourth line of separation extending between said transverse line of weakness and said additional transverse line of separation and a fifth line of separation extending between said transverse line of weakness and said additional line of weakness substantially parallel to and laterally spaced from said fourth line of separation, said transverse line of weakness, said additional transverse line of separation, said fourth line of separation and said fifth line of separation defining therein an adhesion region wherein said layer of adhesive includes adhesive applied between said intermediate surface and said back surface and said layer of release coating is substantially not applied between the intermediate surface and said back surface in the area defined by said adhesion region.

6. A distribution marketing piece as set forth in claim 1, further including a card adhesively attached to the uppermost side of the second section of the top ply.

7. A distribution marketing piece as set forth in claim 1, further including indicia printed on at least the uppermost side of the top ply using a four color process.

8. A distribution marketing piece assembly comprising:

a substrate selected from the group consisting of an envelope, a tube, a carton and a container; and a distribution marketing piece adhesively affixed to the substrate, wherein said distribution marketing piece comprises:

a first section of a top ply having an uppermost side and a back side, a top edge, and first and second side edges, said first section including first and second side strips, a bottom edge strip, and an upper border section adhesively adhered to the substrate, and a central portion which is not adhered to the substrate, a pocket being defined between said substrate and said central portion and substantially surrounded by said bottom edge strip, said first and second side strips, and said upper border section;

a separate center section of the top ply being separated from said first section and received in said pocket, wherein said first section further includes first and second transverse lines of weakness extending at least a substantial portion of the distance across said first section between said first and second side edges to present a tear strip for separating said bottom edge strip from the remainder of said first section, wherein said first section further includes third and fourth lines positioned substantially respectively between said first and second side strips and said central portion and oriented generally perpendicular to and intersecting with said second transverse line of weakness, and wherein said first section further includes a further transverse line of weakness positioned substantially between said upper border section and said central portion, said further transverse line of weakness extending between and substantially perpendicular to said third and fourth lines of weakness.

9. A distribution marketing piece assembly as set forth in claim 8, further including a liner ply adhesively attached to a part of the central portion and a part of the center section, the further transverse line of weakness in the first section also extending into the liner ply.

10. A distribution marketing piece assembly as set forth in claim 8, further including an insert separate from said center section received in said pocket.

11. A distribution marketing piece assembly as set forth in claim 8, further including a card adhesively attached to the center section.

12. A method of adhering a marketing piece to a substrate comprising the steps of:

providing a marketing piece having a top ply having a uppermost side and a back side, said top ply including a first section and a second section separated by a first transverse line of separation, a liner ply having an intermediate surface and a back surface and adhesively connected to said first section and said second section, and a layer of adhesive between a selected portion of the liner ply and the top ply;

removing a portion of the liner ply from the top ply to expose adhesive from said layer of adhesive remaining with the back side of the top ply along an upper border section, first and second side strips, and a bottom edge strip of a first section of the top ply;

positioning the second section proximate said substrate whereby said uppermost side of the second section is facing the substrate and the back side of the second section is uppermost folding said liner ply and adhering the back side of the upper border section, first and second side strips and bottom edge strip to the substrate in surrounding relationship to the second section, wherein the second section and a central portion of the first section are not directly adhered to the substrate;

placing an insert adjacent the second section prior to adhering the upper border section, first and second side strips and bottom edge strips to the substrate; and positioning a card adhered to the second section between the second section and the substrate.

* * * * *